US012403378B1

(12) United States Patent
Lu

(10) Patent No.: US 12,403,378 B1
(45) Date of Patent: Sep. 2, 2025

(54) LAPTOP STAND ADAPTED FOR TREADMILL

(71) Applicant: Meizhou Fusheng Home Technology Co., Ltd., Meizhou (CN)

(72) Inventor: Jinglin Lu, Meizhou (CN)

(73) Assignee: MEIZHOU FUSHENG HOME TECHNOLOGY CO., LTD., Meizhou (CN)

( * ) Notice: Subject to any disclaimer, the term of this patent is extended or adjusted under 35 U.S.C. 154(b) by 0 days.

(21) Appl. No.: 19/069,644

(22) Filed: Mar. 4, 2025

(30) Foreign Application Priority Data

Feb. 25, 2025 (CN) ..... 202520311448.9

(51) Int. Cl.
*A63B 71/06* (2006.01)

(52) U.S. Cl.
CPC .. *A63B 71/0622* (2013.01); *A63B 2071/0658* (2013.01)

(58) Field of Classification Search
CPC ..... F16M 13/022; F16M 11/26; A47K 3/001; A63B 71/0622; A47B 23/06
USPC ..... 248/441.1
See application file for complete search history.

(56) References Cited

U.S. PATENT DOCUMENTS

| | | | | |
|---|---|---|---|---|
| 9,010,714 | B2 * | 4/2015 | Weldon | F16M 11/26 248/448 |
| 10,874,208 | B1 * | 12/2020 | Knapp | A63B 71/0622 |
| 11,541,273 | B2 * | 1/2023 | Li | F16M 13/022 |
| 11,569,860 | B2 * | 1/2023 | Gu | A47B 23/06 |

* cited by examiner

*Primary Examiner* — Todd M Epps

(57) ABSTRACT

A laptop stand adapted for a treadmill includes a carrying plate, a telescopic bracket, a crossbeam assembly and a fixing assembly. The carrying plate is configured to carry a laptop computer; the telescopic bracket is foldable and telescopic; one end of the telescopic bracket is rotatably connected to the carrying plate, and the other end of the telescopic bracket is rotatably connected to an upper end of the crossbeam assembly; the telescopic bracket is configured to support the carrying plate; the fixing assembly is connected to a lower end of the crossbeam assembly, and the fixing assembly is configured to clamp a handrail of the treadmill so as to fix the laptop stand onto the treadmill.

20 Claims, 6 Drawing Sheets

LAPTOP STAND ADAPTED FOR TREADMILL

CROSS-REFERENCE TO RELATED APPLICATIONS

The application claims priority of Chinese patent application CN202520311448.9, filed on Feb. 25, 2025, which is incorporated herein by reference in its entireties.

TECHNICAL FIELD

The present invention relates to a field of laptop stands, in particular to a laptop stand adapted for a treadmill.

BACKGROUND

In recent years, using a treadmill for exercise has become a popular fitness choice for many people in their spare time. However, running on a treadmill can often be boring and monotonous, making it hard for people to stay focused. Fortunately, using a laptop computer for entertainment and office work while running on the treadmill can enhance the enjoyment of running and make better use of time. As a result, a laptop stand adapted for a treadmill has become a necessity. However, most existing laptop stands for treadmills have core shortcomings, such as a fixed height and a large space occupation. Additionally, conventional laptop stands for treadmills often use adjustable straps to be tied to the treadmill, which leads to unstable and oscillatory movement, significantly affecting the user experience. Therefore, the present invention provides a laptop stand adapted for a treadmill, which can effectively solve the above problems.

SUMMARY

In order to overcome the shortcomings of the prior art, the present invention provides a laptop stand adapted for a treadmill, which includes a carrying plate, a telescopic bracket, a crossbeam assembly and a fixing assembly.

The carrying plate is configured to carry a laptop computer; the telescopic bracket is foldable and telescopic; one end of the telescopic bracket is rotatably connected to the carrying plate, and the other end of the telescopic bracket is rotatably connected to an upper end of the crossbeam assembly; the telescopic bracket is configured to support the carrying plate; the fixing assembly is connected to a lower end of the crossbeam assembly, and the fixing assembly is configured to clamp a handrail of the treadmill so as to fix the laptop stand onto the treadmill.

Furthermore, the telescopic bracket includes a first connecting rod, a second connecting rod, a third connecting rod, and a fourth connecting rod; each end of the first connecting rod, the second connecting rod, the third connecting rod, and the fourth connecting rod is provided with a connection hole; one end of the first connecting rod is rotatably connected to the crossbeam assembly, the other end of the first connecting rod is rotatably connected to one end of the second connecting rod, and the other end of the second connecting rod is rotatably connected to the carrying plate; one end of the third connecting rod is rotatably connected to the crossbeam assembly, the other end of the third connecting rod is rotatably connected to one end of the fourth connecting rod, and the other end of the fourth connecting rod is rotatably connected to the carrying plate.

Furthermore, the telescopic bracket further includes a cross rod; each end of the cross rod is provided with a connection hole; one end of the cross rod is rotatably connected to a joint between the first connecting rod and the second connecting rod, and the other end of the cross rod is rotatably connected to a joint between the third connecting rod and the fourth connecting rod.

Furthermore, the crossbeam assembly includes a crossbeam main body and a connecting plate; one side of the connecting plate is rotatably connected to the telescopic bracket, and one side of the connecting plate is slidably disposed on the crossbeam main body.

Furthermore, the connecting plate includes a first support piece and a second support piece; the first support piece and the second support piece are vertically disposed on the connecting plate, and each of the first support piece and the second support piece is provided with a connection hole; one end of the first connecting rod is rotatably connected to the first support piece, and one end of the third connecting rod is rotatably connected to the second support piece.

Furthermore, the carrying plate includes a third support piece and a fourth support piece; the third support piece and the fourth support piece are vertically disposed on a back side of the carrying plate, and each of the third support piece and the fourth support piece is provided with a connection hole; one end of the second connecting rod is rotatably connected to the third support piece, and one end of the fourth connecting rod is rotatably connected to the fourth support piece.

Furthermore, the carrying plate further includes a carrying end; the carrying end is disposed at the lowermost end of the carrying plate, and the carrying end is L-shaped.

Furthermore, the carrying plate is provided with heat dissipation holes.

Furthermore, a second sliding channel and a third sliding channel are disposed in parallel on an upper end surface of the crossbeam main body; the crossbeam main body further includes a plurality of sliders, and the sliders are configured to slide within the second sliding channel and the third sliding channel; each of the second sliding channel and the third sliding channel has an opening provided with an inward-extending protruding strip, so that the opening of the second sliding channel is less than an inner diameter of the second sliding channel and the opening of the third sliding channel is less than an inner diameter of the third sliding channel; the protruding strip is configured to prevent the sliders from sliding out of the second sliding channel and the third sliding channel; the connecting plate is connected to the plurality of sliders through fasteners.

Furthermore, the fixing assembly is configured to be slidably disposed on a lower end surface of the crossbeam main body.

Furthermore, a fourth sliding channel and a fifth sliding channel are disposed in parallel on the lower end surface of the crossbeam main body; the plurality of sliders are slidably disposed within the fourth sliding channel and the fifth sliding channel; each of the fourth sliding channel and the fifth sliding channel has an opening provided with an inward-extending protruding strip, so that the opening of the fourth sliding channel is less than an inner diameter of the fourth sliding channel and the opening of the fifth sliding channel is less than an inner diameter of the fifth sliding channel; the protruding strip is configured to prevent the sliders from sliding out of the fourth sliding channel and the fifth sliding channel; the fixing assembly is connected to the plurality of sliders through the fasteners.

Furthermore, the fixing assembly includes a first clamping plate, a second clamping plate and an adjustment member; the first clamping plate and the second clamping plate are disposed oppositely and spaced apart by a distance; the adjustment member penetrates through the second clamping plate; the adjustment member is configured to vary a distance between the adjustment member and the first clamping plate.

Furthermore, the adjustment member includes a bolt, a third clamping plate and a knob; the bolt penetrates through the second clamping plate; one end of the bolt is connected to the knob, and the other end of the bolt is connected to the third clamping plate; the third clamping plate is disposed between the first clamping plate and the second clamping plate.

Furthermore, each of the first clamping plate and the third clamping plate is provided with an anti-slip pad.

Furthermore, the laptop stand adapted for a treadmill further includes a tray slidably disposed on the crossbeam assembly.

Furthermore, a first sliding channel is disposed on the crossbeam main body; the plurality of sliders are slidably disposed within the first sliding channel; the first sliding channel has an opening provided with an inward-extending protruding strip, so that the opening of the first sliding channel is less than an inner diameter of the first sliding channel; the protruding strip is configured to prevent the sliders from sliding out of the first sliding channel; the tray is connected to the plurality of sliders through the fasteners.

Furthermore, the crossbeam assembly further includes stoppers mounted on both sides of the crossbeam main body.

Furthermore, the crossbeam main body is further provided with a sixth sliding channel; the crossbeam main body includes a first crossbeam, a second crossbeam and a connection member; the connection member is configured to connect the first crossbeam and the second crossbeam such that the first crossbeam and the second crossbeam are fixedly connected, and the connection member is disposed within the first sliding channel and the sixth sliding channel.

Furthermore, the number of the fixing assembly is two.

Furthermore, the carrying plate is provided with a plurality of anti-slip pads.

The beneficial effects of the present invention are as follows. The present invention provides a laptop stand adapted for a treadmill. By providing a telescopic bracket to connect the crossbeam assembly and the carrying plate, the telescopic bracket can be extended and retracted to adjust the height of the carrying plate. Users can raise or lower the height of the laptop computer according to their needs, which provides significant convenience for users. A plurality of sliding channels are provided on the crossbeam assembly. The telescopic bracket, the fixing assembly, and the tray are all slidably disposed within the sliding channels. This enables users to adjust their positions by sliding at any time. The tray can hold a mouse or other items, enhancing the user experience. At the same time, the connection method through the sliding channels also enables users to install and remove the laptop stand quickly. Two fixing assemblies clamp the handrail of the treadmill through the first clamping plate and the third clamping plate. The two fixing assemblies can adjust their positions according to the distance between the handrails of different treadmills, enabling the laptop stand adapted for a treadmill to clamp more stably on the treadmill handrail, improving safety and the user experience. The overall design of the laptop stand adapted for a treadmill is compact. When the telescopic bracket is folded, it will not encroach on the user's running space.

BRIEF DESCRIPTION OF THE DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

The technical solutions in the embodiments of the present invention will be clearly and completely described below in conjunction with the accompanying drawings in the embodiments of the present invention. Apparently, the described embodiments are only a part of the embodiments of the present invention, rather than all the embodiments. Based on the embodiments in the present invention, all other embodiments obtained by those ordinarily skilled in the art without doing creative work shall fall within the protection scope of the present invention.

Figure 1:
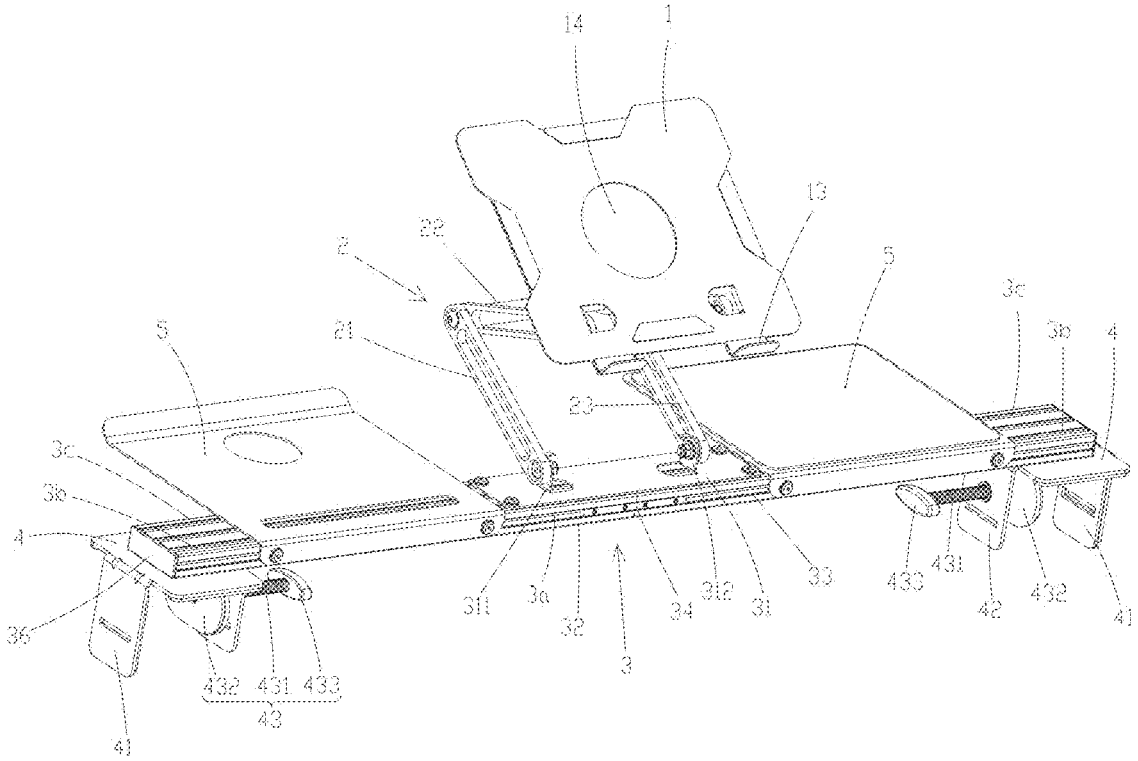
FIG. 1 is a 3D structural schematic diagram of the laptop stand adapted for a treadmill according to the present invention.
Figure 2:
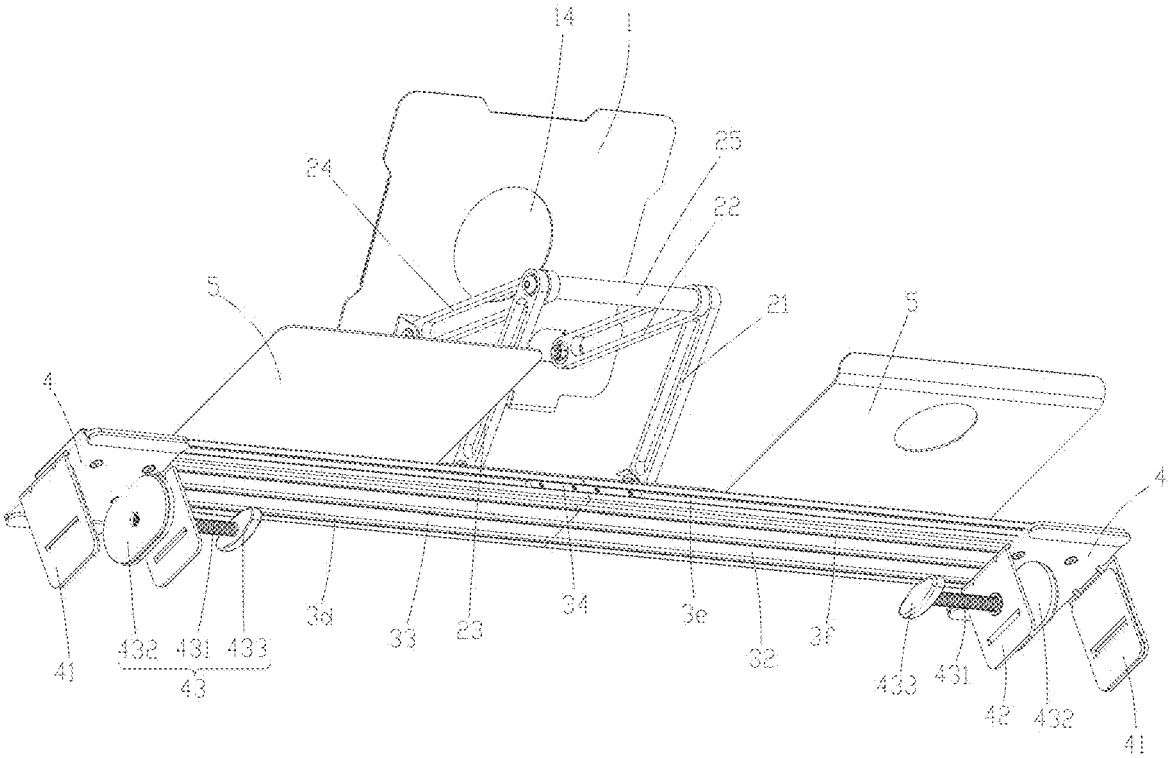
FIG. 2 is a 3D structural schematic diagram from another angle of the laptop stand adapted for a treadmill according to the present invention.
Figure 3:
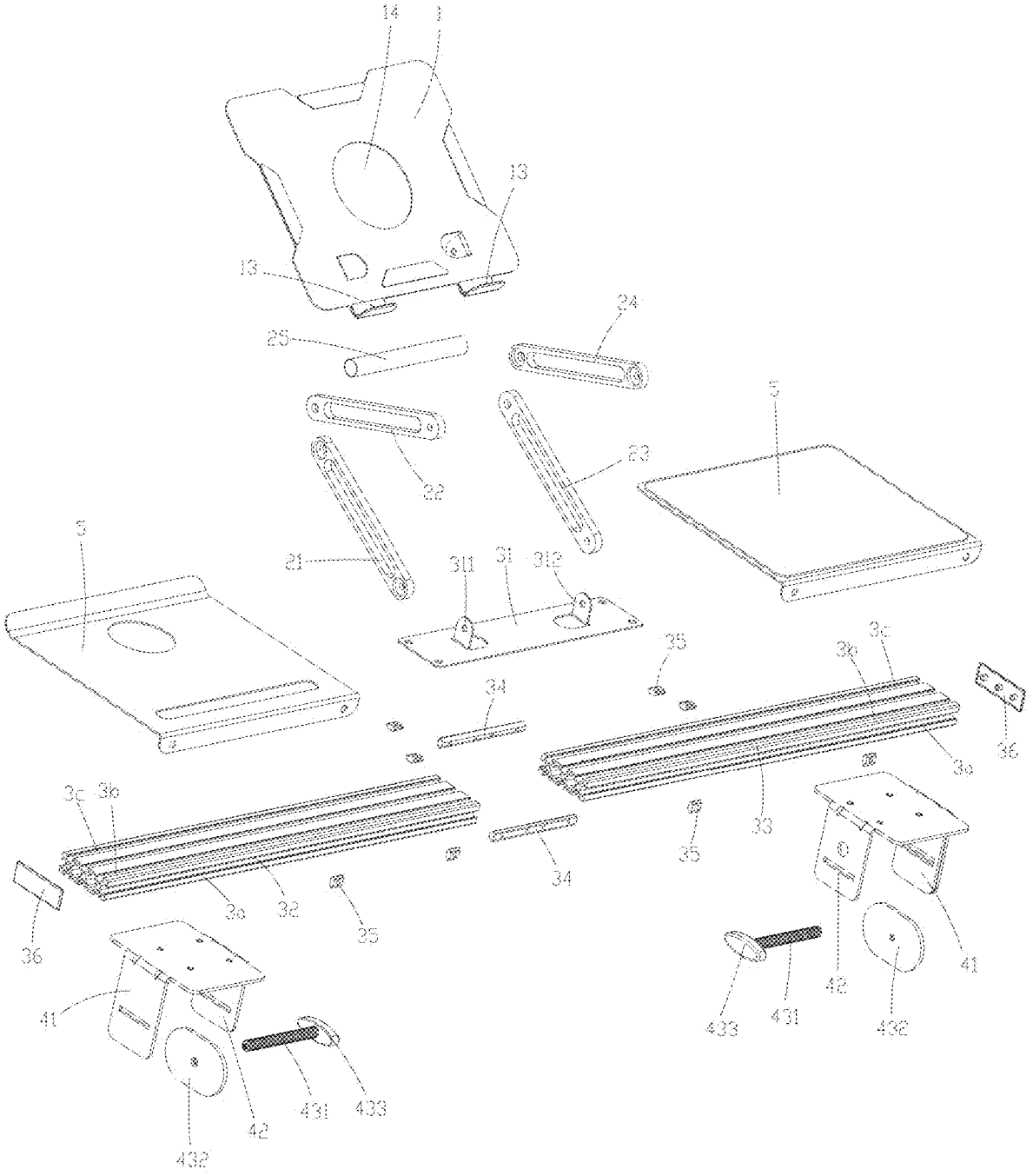
FIG. 3 is an exploded view of the laptop stand adapted for a treadmill according to the present invention.
Figure 4:
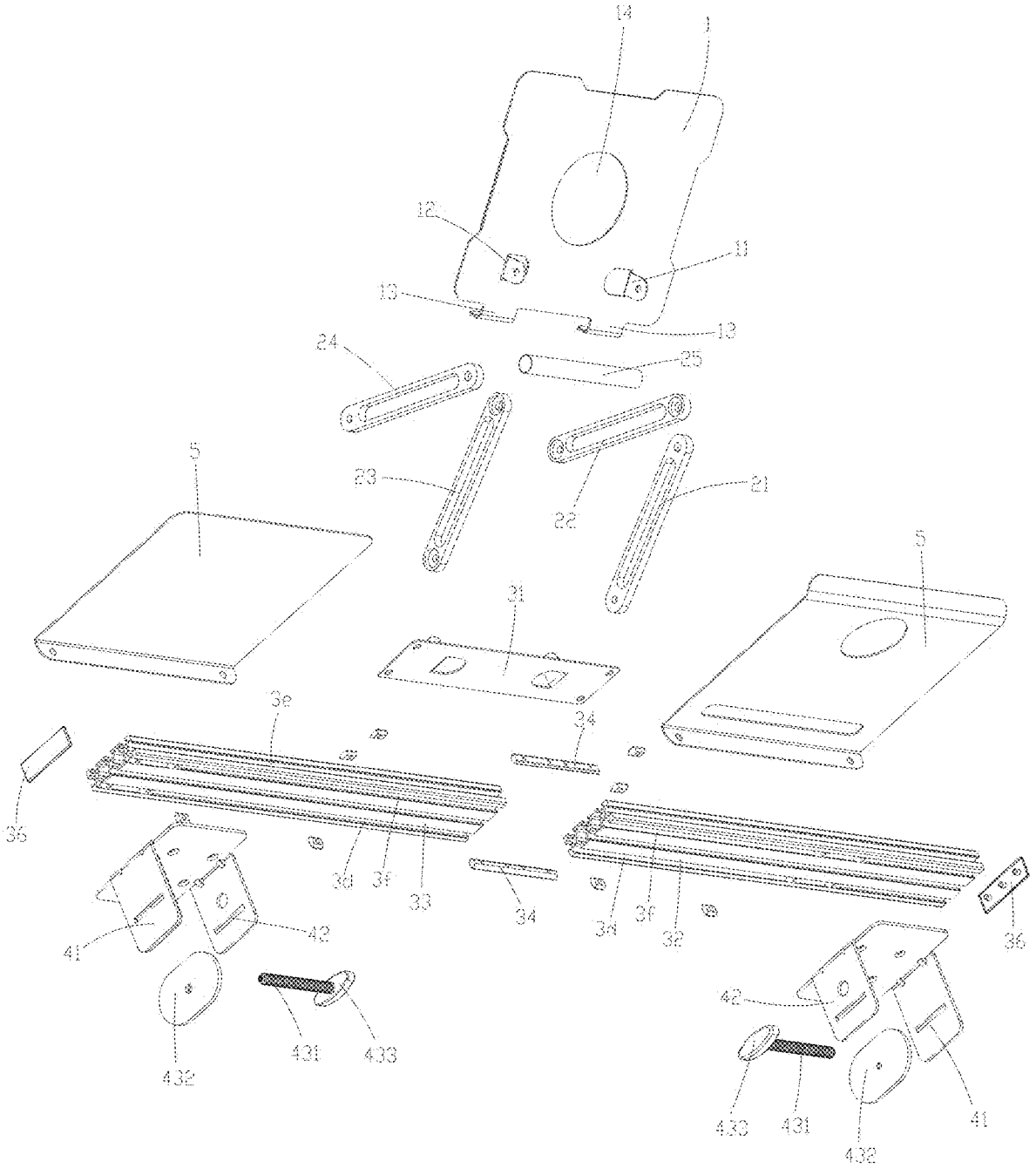
FIG. 4 is an exploded view from another angle of the laptop stand adapted for a treadmill according to the present invention.
Figure 5:
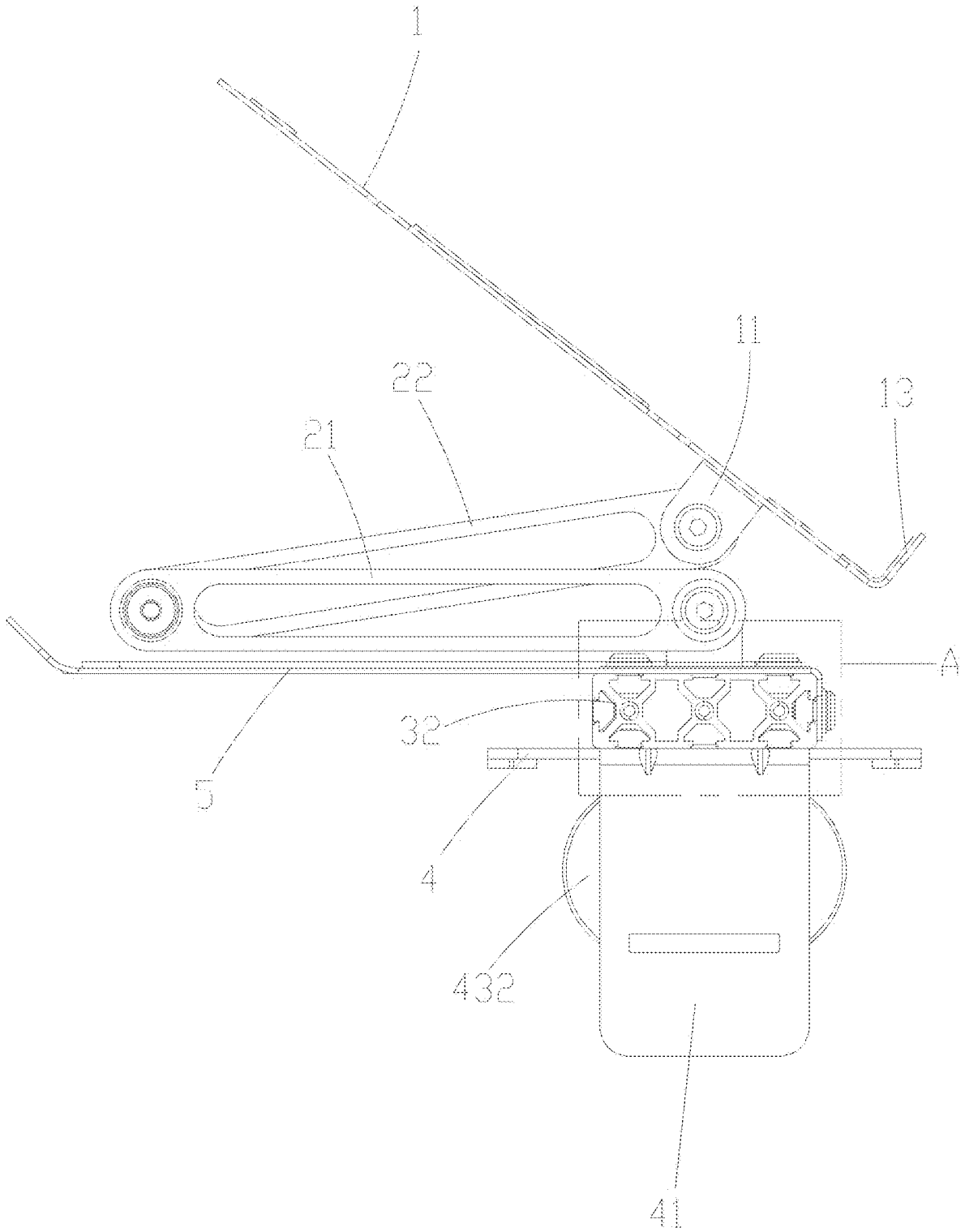
FIG. 5 is a side view of the laptop stand adapted for a treadmill according to the present invention.
Figure 6:
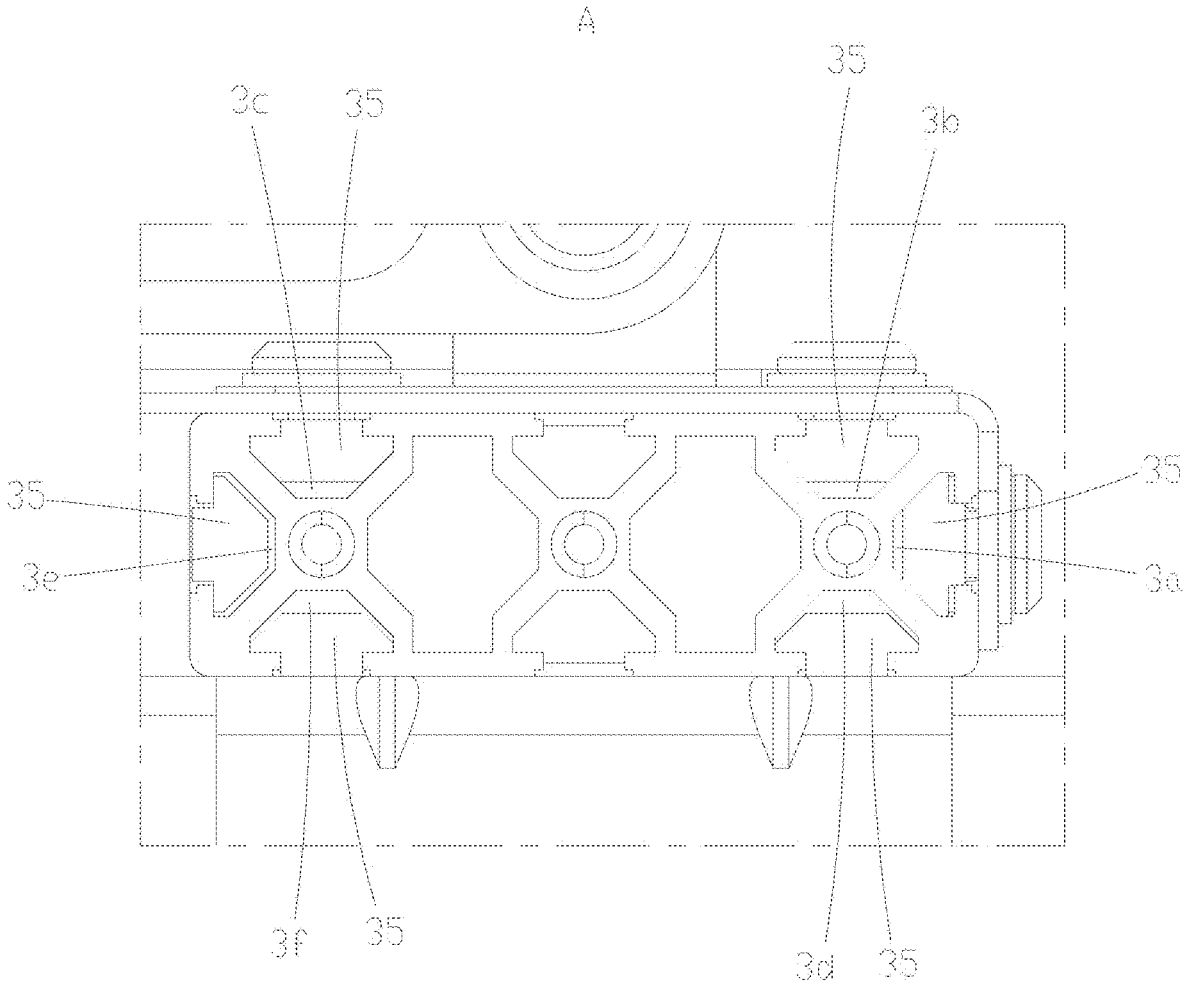
FIG. 6 is an enlarged view of Area A in FIG. 5.
Figure 7:
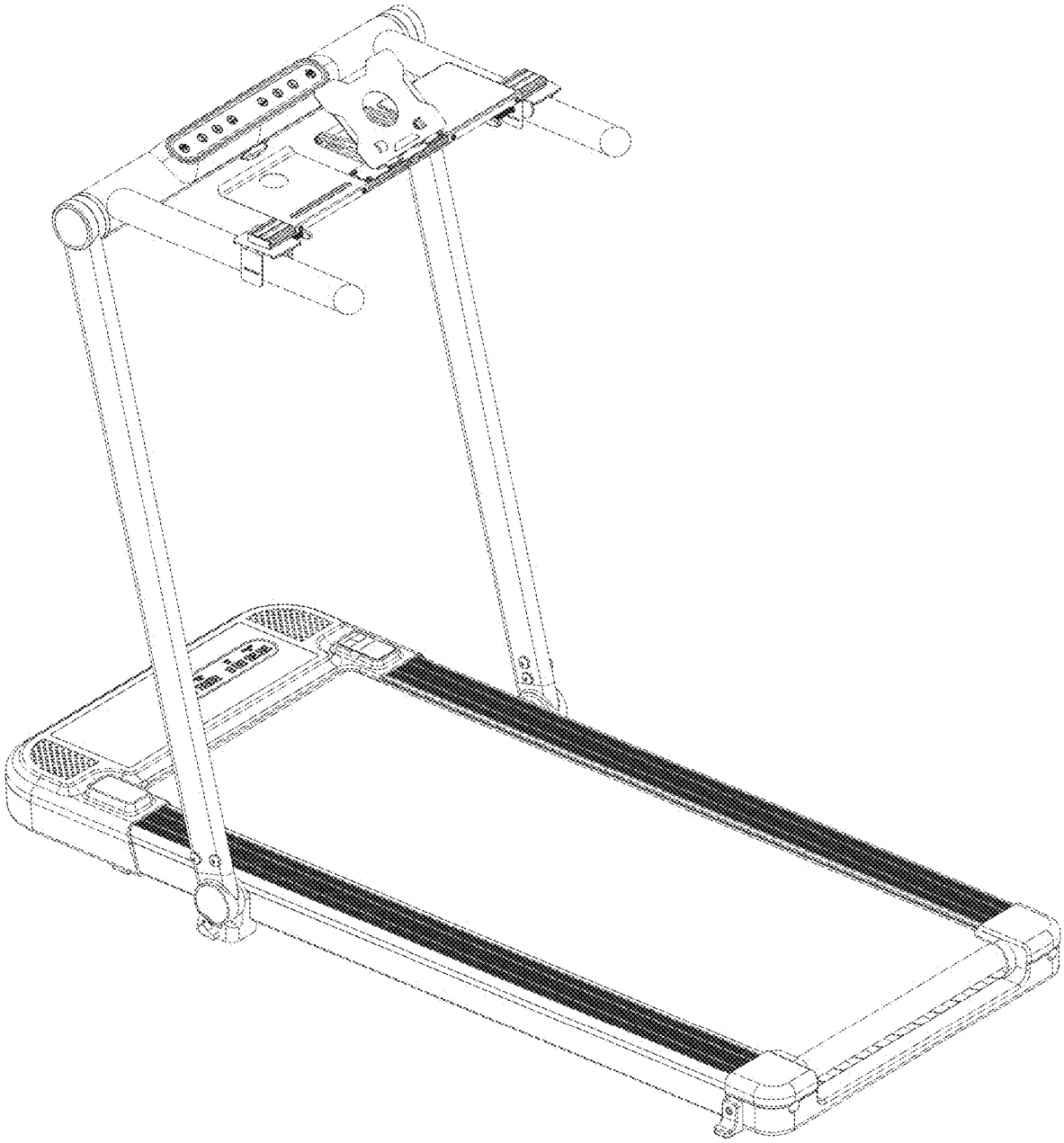
FIG. 7 is a reference diagram of a usage state of the laptop stand adapted for a treadmill according to the present invention when the laptop stand is installed on a treadmill.

Referring to FIG. 1 to FIG. 7, the present invention provides a laptop stand adapted for a treadmill, which includes a carrying plate 1, a telescopic bracket 2, a crossbeam assembly 3 and a fixing assembly 4. The carrying plate 1 is configured to carry a laptop computer; the telescopic bracket 2 is foldable and telescopic; one end of the telescopic bracket 2 is rotatably connected to the carrying plate 1, and the other end of the telescopic bracket 2 is rotatably connected to an upper end of the crossbeam assembly 3; the telescopic bracket 2 is configured to support the carrying plate 1; the fixing assembly 4 is connected to a lower end of the crossbeam assembly 3, and the fixing assembly 4 is configured to clamp a handrail of the treadmill so as to fix the laptop stand onto the treadmill.

It can be understood that, through the above structure, the laptop stand adapted for a treadmill is fixed by clamping the handrails of the treadmill with the two fixing assemblies 4 connected below the crossbeam assembly 3. This clamping-type fixing method ensures that the laptop stand adapted for a treadmill is more firmly fixed on the handrails of the treadmill. The fixing assemblies 4 are slidably connected to the crossbeam assembly 3, which facilitates users to slide and adjust the positions of the two fixing assemblies 4 according to the distance between the handrails of the treadmill.

One end of the telescopic bracket 2 is rotatably connected to the carrying plate 1, and the other end of the telescopic bracket 2 is rotatably connected to the crossbeam assembly 3. The telescopic bracket 2 can be telescoped by folding, allowing the carrying plate 1 to be raised or lowered, thereby enabling users to adjust the height of the carrying plate according to their actual usage needs. The carrying plate 1 is configured to support a laptop computer.

One end of the cross rod 25 is connected to the joint of the first connecting rod 21 and the second connecting rod 22, and the other end of the cross rod 25 is connected to the joint of the third connecting rod 23 and the fourth connecting rod 24. This is used to make the support of the four connecting rods more stable and prevent them from tilting.

A third support piece 11 and a fourth support piece 12 are provided on the back of the carrying plate 1. Connection holes are provided on both the third support piece 11 and the fourth support piece 12. By inserting fasteners into the connection holes of the second connecting rod 22 and the third support piece 11, one end of the second connecting rod 22 is rotatably connected to the third support piece 11. A damping sheet is provided at the joint between the second connecting rod 22 and the third support piece 11, allowing one end of the second connecting rod 22 to be fixed in a certain position after rotation relative to the third support piece 11. By inserting fasteners into the connection holes of the fourth connecting rod 24 and the fourth support piece 12, the fourth connecting rod 24 is rotatably connected to the fourth support piece 12. A damping sheet is provided at the joint between the fourth connecting rod 24 and the fourth support piece 12, allowing the fourth connecting rod 24 to be fixed in a certain position after rotation relative to the fourth support piece 12.

Through the above structure, through the rotational connection between the first connecting rod 21 and the second connecting rod 22, as well as the rotational connection between the third connecting rod 23 and the fourth connecting rod 24, the folding and telescoping function of the telescopic bracket 2 can be realized. Users can adjust the telescopic bracket 2 to change the height of the carrying plate 1. Meanwhile, they can also rotate the carrying plate 1 to change its angle, which facilitates users to adjust the carrying plate 1 to a satisfactory height and angle according to different usage requirements.

Furthermore, the carrying plate is provided with heat dissipation holes. This can provide better heat dissipation for the laptop when the user is using it.

A carrying end 13 is disposed at the lowermost end of the carrying plate 1. The carrying end 13 is L-shaped. When a laptop computer is placed on the carrying plate 1, the carrying end 13 can support the edge of the laptop computer to prevent the laptop computer from sliding off the carrying plate 1. A plurality of anti-slip pads are provided on the carrying plate 1. These anti-slip pads can enhance the friction between the laptop computer and the carrying plate 1, preventing the laptop computer from sliding and protecting the laptop computer from scratches.

Furthermore, the crossbeam assembly 3 includes a crossbeam main body. The crossbeam main body is in the shape of a cuboid. A plurality of sliding channels are disposed on the four surfaces of the crossbeam main body. A plurality of sliders 35 are disposed within the sliding channels and are configured to slide therein. Each opening of the sliding channels has an inward-extending protruding strip, so that the opening of each sliding channel is less than its inner diameter, preventing the sliders 35 from sliding out. The crossbeam main body is provided with a removable stopper 36 to prevent the sliders 35 from falling out of the sliding channels. Specifically, the sliding channels include the first sliding channel 3*a*, the second sliding channel 3*b*, the third sliding channel 3*c*, the fourth sliding channel 3*d*, the fifth sliding channel 3*f*, and the sixth sliding channel 3*e*. The crossbeam assembly 3 also includes a connecting plate 31. The connecting plate 31 is connected to the sliders 35 in the second sliding channel 3*b* and the third sliding channel 3*c* through fasteners, enabling the connecting plate 31 to slide along the second sliding channel 3*b* and the third sliding channel 3*c*. The connecting plate 31 is provided with a first support piece 311 and a second support piece 312. Connection holes are disposed on the first support piece 311 and the second support piece 312. By inserting fasteners into the connection holes of the first connecting rod 21 and the first support piece 311, the first connecting rod 21 is rotatably connected to the first support piece 311. A damping sheet is provided at the joint between the first connecting rod 21 and the first support piece 311, allowing the first connecting rod 21 to be fixed in a certain position after rotation relative to the first support piece 311. By inserting fasteners into the connection holes of the second connecting rod 22 and the second support piece 312, the second connecting rod 22 is rotatably connected to the second support piece 312. A damping sheet is provided at the joint between the second connecting rod 22 and the second support piece 312, allowing the second connecting rod 22 to be fixed in a certain position after rotation relative to the second support piece 312.

Through the above structure, it is convenient for users to slide and adjust the position of the laptop computer, further enhancing the user experience.

Furthermore, the two fixing assemblies 4 are connected to the sliders 35 in the fourth sliding channel 3*d* and the fifth sliding channel 3*f* through fasteners, enabling the fixing assemblies to slide along the fourth sliding channel 3*d* and the fifth sliding channel 3*f*. This enables users to adjust the distance between the two fixing assemblies 4 according to the width of the treadmill handrails, allowing for better fixation of the laptop stand adapted for a treadmill.

Furthermore, the fixing assembly 4 includes a first clamping plate 41, a second clamping plate 42, and an adjustment member 43. Specifically, the adjustment member 43 includes a bolt 431, a third clamping plate 432, and a knob 433. The bolt 431 penetrates through the second clamping plate 42. One end of the bolt 431 is connected to the third clamping plate 432, and the third clamping plate 432 is disposed between the first clamping plate 41 and the second clamping plate 42. The first clamping plate 41 and the third clamping plate 432 are configured to clamp the handrail of the treadmill. The other end of the bolt 431 is connected to the knob 433. Users can rotate the knob 433 to make the third clamping plate 432 move closer to or away from the first clamping plate 41, so as to vary the distance between the third clamping plate 432 and the first clamping plate 41. The anti-slip pads are disposed on both the first clamping plate 41 and the third clamping plate 432 to enhance the friction, making the fixing assembly 4 hold the handrail of the treadmill more firmly.

Through the above structure, the way that the first clamping plate 41 and the third clamping plate 432 clamp the handrail of the treadmill can make the laptop stand adapted for a treadmill more stable when it is installed on the treadmill. Moreover, the adjustment by rotating the bolt is more convenient.

Furthermore, the crossbeam main body is composed of two connected parts, namely a first crossbeam 32 and a second crossbeam 33. The first crossbeam 32 and the second crossbeam 33 are fixedly connected by two connection members 34. The connection members 34 are respectively disposed within the first sliding channel 3*a* and the sixth sliding channel 3*e*.

Furthermore, the laptop stand adapted for a treadmill further includes a tray 5. The tray 5 is connected to the slider 35 in the first sliding channel 3*a* through fasteners, enabling the tray 5 to slide along the first sliding channel 3*a*, which facilitates users in adjusting its position. The tray 5 may be provided in multiple instances, disposed on both sides of the telescopic bracket 2. This configuration accommodates both left-handed and right-handed users by allowing mouse use on the trays, thereby enhancing usability across diverse user groups.

As described above, one or more embodiments are provided in conjunction with the detailed description, The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

What is claimed is:

1. A laptop stand adapted for a treadmill, comprising:

a carrying plate;

a telescopic bracket;

a crossbeam assembly; and a fixing assembly, wherein the carrying plate is configured to carry a laptop computer; the telescopic bracket is foldable and telescopic; a first end of the telescopic bracket is rotatably connected to the carrying plate, and a second end of the telescopic bracket is rotatably connected to an upper end of the crossbeam assembly; the telescopic bracket is configured to support the carrying plate; the fixing assembly is connected to a lower end of the crossbeam assembly, and the fixing assembly is configured to clamp a handrail of the treadmill so as to fix the laptop stand onto the treadmill.

2. The laptop stand adapted for a treadmill according to claim 1, wherein the telescopic bracket comprises a first connecting rod, a second connecting rod, a third connecting rod, and a fourth connecting rod; each end of the first connecting rod, the second connecting rod, the third connecting rod, and the fourth connecting rod is provided with a connection hole; a first end of the first connecting rod is rotatably connected to the crossbeam assembly, a second end of the first connecting rod is rotatably connected to a first end of the second connecting rod, and a second end of the second connecting rod is rotatably connected to the carrying plate; a first end of the third connecting rod is rotatably connected to the crossbeam assembly, a second end of the third connecting rod is rotatably connected to a first end of the fourth connecting rod, and a second end of the fourth connecting rod is rotatably connected to the carrying plate.

3. The laptop stand adapted for a treadmill according to claim 2, wherein the carrying plate comprises a third support piece and a fourth support piece; the third support piece and the fourth support piece are vertically disposed on a back side of the carrying plate, and each of the third support piece and the fourth support piece is provided with a connection hole; the first end of the second connecting rod is rotatably connected to the third support piece, and the first end of the fourth connecting rod is rotatably connected to the fourth support piece.

4. The laptop stand adapted for a treadmill according to claim 2, wherein the telescopic bracket further comprises a cross rod; each end of the cross rod is provided with a connection hole; a first end of the cross rod is rotatably connected to a joint between the first connecting rod and the second connecting rod, and a second end of the cross rod is rotatably connected to a joint between the third connecting rod and the fourth connecting rod.

5. The laptop stand adapted for a treadmill according to claim 4, wherein the crossbeam assembly comprises a crossbeam main body and a connecting plate; one side of the connecting plate is rotatably connected to the telescopic bracket, and one side of the connecting plate is slidably disposed on the crossbeam main body.

6. The laptop stand adapted for a treadmill according to claim 5, wherein the connecting plate comprises a first support piece and a second support piece; the first support piece and the second support piece are vertically disposed on the connecting plate, and each of the first support piece and the second support piece is provided with a connection hole; the first end of the first connecting rod is rotatably connected to the first support piece, and the first end of the third connecting rod is rotatably connected to the second support piece.

7. The laptop stand adapted for a treadmill according to claim 5, wherein the crossbeam assembly further comprises stoppers mounted on both sides of the crossbeam main body.

8. The laptop stand adapted for a treadmill according to claim 5, wherein a second sliding channel and a third sliding channel are disposed in parallel on an upper end surface of the crossbeam main body; the crossbeam main body further comprises a plurality of sliders, and the sliders are configured to slide within the second sliding channel and the third sliding channel; each of the second sliding channel and the third sliding channel has an opening provided with an inward-extending protruding strip, so that the opening of the second sliding channel is less than an inner diameter of the second sliding channel and the opening of the third sliding channel is less than an inner diameter of the third sliding channel; the protruding strip is configured to prevent the sliders from sliding out of the second sliding channel and the third sliding channel; the connecting plate is connected to the plurality of sliders through fasteners.

9. The laptop stand adapted for a treadmill according to claim 8, wherein the fixing assembly is configured to be slidably disposed on a lower end surface of the crossbeam main body.

10. The laptop stand adapted for a treadmill according to claim 9, wherein a fourth sliding channel and a fifth sliding channel are disposed in parallel on the lower end surface of the crossbeam main body; the plurality of sliders are slidably disposed within the fourth sliding channel and the fifth sliding channel; each of the fourth sliding channel and the fifth sliding channel has an opening provided with an inward-extending protruding strip, so that the opening of the fourth sliding channel is less than an inner diameter of the fourth sliding channel and the opening of the fifth sliding channel is less than an inner diameter of the fifth sliding channel; the protruding strip is configured to prevent the sliders from sliding out of the fourth sliding channel and the fifth sliding channel; the fixing assembly is connected to the plurality of sliders through the fasteners.

11. The laptop stand adapted for a treadmill according to claim 8, further comprising a tray slidably disposed on the crossbeam assembly.

12. The laptop stand adapted for a treadmill according to claim 11, wherein a first sliding channel is disposed on the crossbeam main body; the plurality of sliders are slidably disposed within the first sliding channel; the first sliding channel has an opening provided with an inward-extending protruding strip, so that the opening of the first sliding channel is less than an inner diameter of the first sliding channel; the protruding strip is configured to prevent the sliders from sliding out of the first sliding channel; the tray is connected to the plurality of sliders through the fasteners.

13. The laptop stand adapted for a treadmill according to claim 12, wherein the crossbeam main body is further provided with a sixth sliding channel; the crossbeam main body comprises a first crossbeam, a second crossbeam and a connection member; the connection member is configured to connect the first crossbeam and the second crossbeam such that the first crossbeam and the second crossbeam are fixedly connected, and the connection member is disposed within the first sliding channel and the sixth sliding channel.

14. The laptop stand adapted for a treadmill according to claim 1, wherein the carrying plate further comprises a carrying end; the carrying end is disposed at the lowermost end of the carrying plate, and the carrying end is L-shaped.

15. The laptop stand adapted for a treadmill according to claim 1, wherein the carrying plate is provided with heat dissipation holes.

16. The laptop stand adapted for a treadmill according to claim 1, wherein the fixing assembly comprises a first clamping plate, a second clamping plate and an adjustment member; the first clamping plate and the second clamping plate are disposed oppositely and spaced apart by a distance; the adjustment member penetrates through the second clamping plate; the adjustment member is configured to vary a distance between the adjustment member and the first clamping plate.

17. The laptop stand adapted for a treadmill according to claim 16, wherein the adjustment member comprises a bolt, a third clamping plate and a knob; the bolt penetrates through the second clamping plate; a first end of the bolt is connected to the knob, and a second end of the bolt is connected to the third clamping plate; the third clamping plate is disposed between the first clamping plate and the second clamping plate.

18. The laptop stand adapted for a treadmill according to claim 17, wherein each of the first clamping plate and the third clamping plate is provided with an anti-slip pad.

19. The laptop stand adapted for a treadmill according to claim 1, further comprising another fixing assembly, a wherein a structure of the another fixing assembly is identical as a structure of the fixing assembly.

20. The laptop stand adapted for a treadmill according to claim 1, wherein the carrying plate is provided with a plurality of anti-slip pads.

* * * * *